US011555669B2

(12) United States Patent
Pischke et al.

(10) Patent No.: US 11,555,669 B2
(45) Date of Patent: Jan. 17, 2023

(54) FIREARM SIGHT WITH MODULAR INTERCHANGEABLE HOODS

(71) Applicant: Sellmark Corporation, Mansfield, TX (US)

(72) Inventors: Andrew Pischke, Mansfield, TX (US); Cody Bench, Irving, TX (US); Jonathan Horton, Arlington, TX (US)

(73) Assignee: Sellmark Corporation, Mansfield, TX (US)

( * ) Notice: Subject to any disclaimer, the term of this patent is extended or adjusted under 35 U.S.C. 154(b) by 43 days.

(21) Appl. No.: 17/340,756

(22) Filed: Jun. 7, 2021

(65) Prior Publication Data

US 2021/0396490 A1 Dec. 23, 2021

Related U.S. Application Data

(60) Provisional application No. 63/042,638, filed on Jun. 23, 2020.

(51) Int. Cl.
*F41G 1/35* (2006.01)
*F41G 11/00* (2006.01)

(52) U.S. Cl.
CPC ..... *F41G 1/35* (2013.01); *F41G 11/004* (2013.01)

(58) Field of Classification Search
CPC ..... F41G 1/35; F41G 11/004
USPC ..... 42/114
See application file for complete search history.

(56) References Cited

U.S. PATENT DOCUMENTS 5,033,219 A * 7/1991 Johnson ..... F41G 1/35 42/126
5,483,362 A * 1/1996 Tai ..... G03H 1/2286 42/114
5,815,936 A * 10/1998 Sieczka ..... G03H 1/0005 42/114
6,813,025 B2 * 11/2004 Edwards ..... F41G 1/38 359/399
7,484,856 B1 * 2/2009 Newhall ..... F41G 1/383 359/511
8,156,679 B1 * 4/2012 Swan ..... F41G 11/003 33/297
9,057,584 B2 * 6/2015 Chung ..... F41G 1/16
(Continued)

FOREIGN PATENT DOCUMENTS

WO 2014024188 A1 2/2014
WO 2016033565 A1 3/2016

OTHER PUBLICATIONS

European Patent Office, Extended European Search Report, European Patent Application No. 21181266.4, dated Nov. 12, 2021.
(Continued)

*Primary Examiner* — Samir Abdosh
(74) *Attorney, Agent, or Firm* — Mark D. Perdue

(57) ABSTRACT

A sighting device is configured to be mounted on a firearm and comprises a core unit that includes a source of electrical power; a hood removably secured to the core unit and enclosing a portion of the core unit and at least partially defining a sight window through the hood; and an electrical connection between the core unit and the hood, wherein electrical power is transmitted between the core unit and the hood. The electrical accessory may be one of a solar charging cell; a laser pointer sighting device powered by the core unit; or a laser range-finding device powered by the core unit.

15 Claims, 9 Drawing Sheets

(56) References Cited

U.S. PATENT DOCUMENTS

| | | | | |
|---|---|---|---|---|
| 9,068,801 | B1 * | 6/2015 | Stecher, Jr. | F41G 11/00 |
| 9,958,234 | B2 * | 5/2018 | Campean | F41G 1/30 |
| 10,042,243 | B1 * | 8/2018 | Metayer | H04N 5/2252 |
| 10,086,527 | B2 * | 10/2018 | Teetzel | F41G 1/36 |
| 10,254,532 | B2 * | 4/2019 | Collin | G02B 23/10 |
| 11,009,315 | B1 * | 5/2021 | Huang | F21S 9/02 |
| 2011/0283585 | A1 * | 11/2011 | Cabahug | F41G 11/003 42/73 |
| 2013/0104438 | A1 * | 5/2013 | Hines | F41G 11/003 42/84 |
| 2019/0049221 | A1 * | 2/2019 | Zimmer | F41G 11/003 |
| 2019/0249958 | A1 * | 8/2019 | Teetzel | F41A 17/08 |
| 2019/0324260 | A1 * | 10/2019 | Hamilton | G02B 23/10 |
| 2020/0041890 | A1 * | 2/2020 | Peel | G03B 17/566 |

OTHER PUBLICATIONS

CVLIFE, 1×22×33 Reflex Sight Red and Green 4 Reticle Dot Sight with 2mW Gun Sight Laser, (https://www.cvlife.com/collections/dot-sight/products/cvlife-tactical-3-9×40-optics-r4-reticle-crosshair-air-sniper-hunting-rifle-scope-with-free-mounts-1, retrieved May 27, 2020), ca. 2020.

Holosun, Solar Powered Reflex Sight HE507C-GR V2, (https://www.holosun.com/index/product/detail/id/105.html, retrieved May 27, 2020), ca. 2020.

* cited by examiner

FIREARM SIGHT WITH MODULAR INTERCHANGEABLE HOODS

CROSS-REFERENCE TO RELATED APPLICATION

This application claims priority to U.S. Provisional Application Ser. No. 63/042,638, filed Jun. 23, 2020, and which is incorporated herein by reference for all purposes.

BACKGROUND OF THE INVENTION

1. Field of the Invention

The present invention relates generally to sighting devices for firearms and related weapons. More specifically, the present invention relates to such sighting devices that include a hood and a secondary or auxiliary part of of the hood.

2. Summary of the Prior Art

The number and functionality of sighting devices and accessories for rifles, pistols, shotguns and other firearms, airguns, and related weapons has grown immensely in the last few decades. Such sights include variations of the traditional "iron" sights, telescopic sights, laser pointer sighting devices, reflex devices, and holographic sights, among others. Accessories, such as flashlights and battery packs to power sights and accessories, are also frequently mounted along with sighting devices.

Each of these types of sighting devices has different strengths and weaknesses depending on the shooting situation, ambient light, and other factors. Accordingly, shooters employ different sighting devices and accessories in different conditions. Many weapons, including pistols and AR-type rifles now include multiple rails to permit a shooter to mount more than one sighting device or accessory to the weapon.

Commonly assigned U.S. Pat. No. 8,769,859 discloses a "tip-off" sight mount that permits more than one sighting device to be mounted on a single rail. The device mounted in the tip-off mount can be moved away from the sighting axis to permit use of another device to aim the weapon. Commonly assigned U.S. Pat. No. 10,969,201 discloses a spring-loaded mounting device that permits sights and accessories to be rapidly attached and detached from a firearm rail without the need to manipulate levers or knobs, or to loosen or tighten screws. These and other devices give the shooter flexibility in changing sights and accessories to fit the situation. Many or most of these solutions add weight or bulk or both to a weapon, making it less wieldy and efficient in shooting operation.

A need exists, therefore, for providing firearms and related weapons with multiple different sighting devices or shooting accessories.

SUMMARY OF THE INVENTION

It is a general object of the invention to provide a sighting device for a firearm that provides increased versatility to the user. This and other objects of the present invention are achieved by providing a sighting device configured to be mounted on a firearm, the device comprising a core unit that includes a source of electrical power. A hood is removably secured to the core unit and encloses a portion of the core unit and at least partially defines a sight picture through the hood. An electrical connection between the core unit and the hood conducts electrical power between the core unit and the hood.

According to one embodiment of the invention, the sighting device is a reflex sight.

According to another embodiment of the invention, the hood includes an electrical accessory formed integrally with or carried by the hood.

According to yet another embodiment of the invention, the electrical accessory is one of: a solar charging cell to provide power to the core unit; a laser pointer sighting device powered by the core unit; and a laser range-finding device powered by the core unit.

Other objects, features, and advantages of the invention will become apparent with reference to the drawings and the detailed description, which follow.

DETAILED DESCRIPTION OF THE INVENTION

Figure 1:
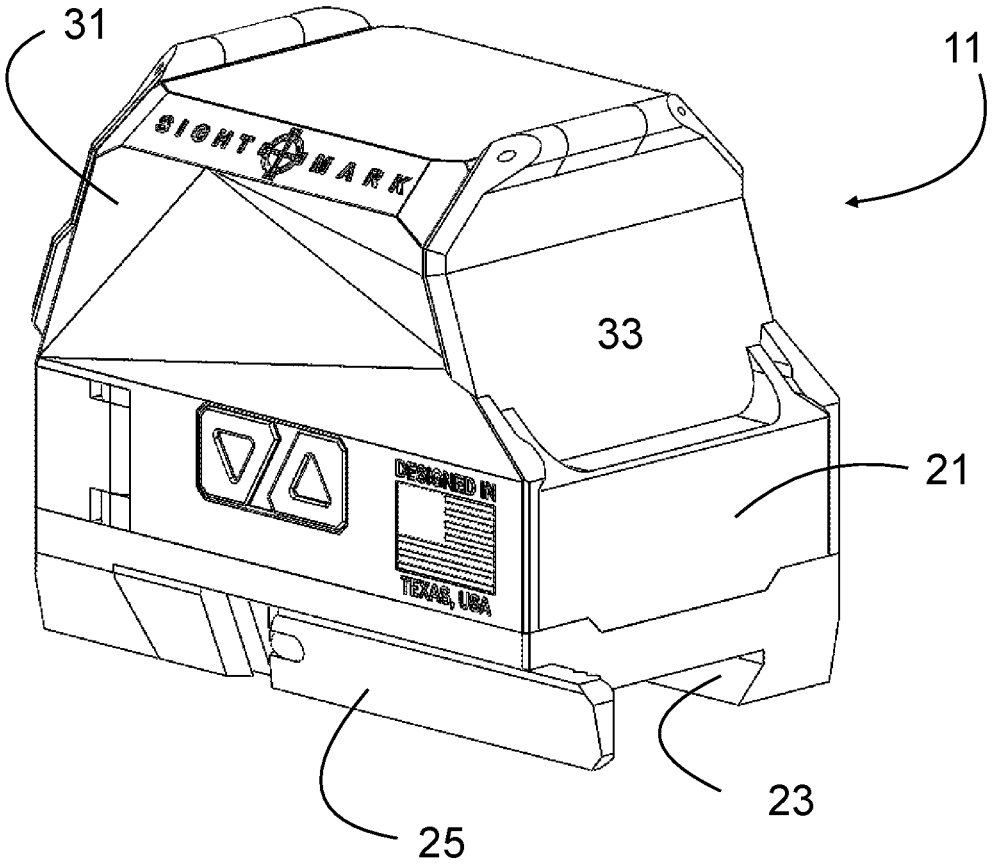
FIG. 1 is a perspective view of a sight in accordance with a preferred embodiment of the present invention.

Referring now to the drawings and in particular FIG. 1, a sighting device or sight 11 in accordance with an embodiment of the present invention is depicted. Sight 11 includes a base or core unit 21, which may house a battery or other electrical power source, electronics, and optics associated with the operation of sight 11, which in this illustrative embodiment is a reflex sight. Core 21 may include a clamp 23, which may be operated by a cammed lever 25, screws, or other means to secure sight 11 on a "Picatinny" or similar rail mounted on a firearm or similar weapon. Other sighting devices, such as holographic or "red dot" sights, "night vision," telescopic sights, or any other type of sight or accessory having the same general configuration may comprise core unit 21. Herein, "firearm" means not only rifles, pistols, shotguns, and weapons conventionally known as firearms, but also includes airguns, bows and other sighted arms or weapons.

A hood 31 extends over the upper surface of core unit 21 and encloses, covers, and protects at least a portion of the optical and other elements of core 21 and sight 11 and provides a sight aperture or window that aids the user in at least partially forming a sight picture. In the embodiment of FIG. 1, hood 31 includes no accessories or secondary or auxiliary sights, but does include an optional hinged lens cap 33 or cover for the objective or front-facing portion of sight 11.

Figure 2:
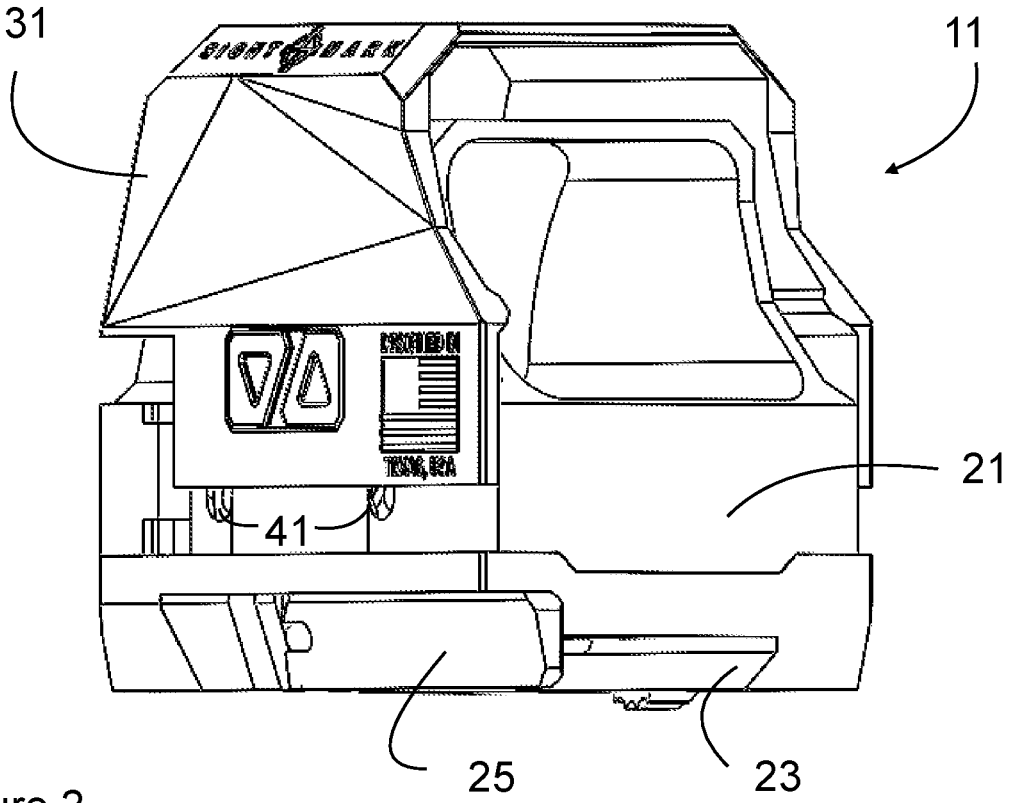
FIG. 2 is a perspective view of the sight of FIG. 1 with the hood partially removed.

FIG. 2 illustrates hood 31 partially removed from core unit 21. As described in greater detail with reference to FIG. 3, hood 31 may be retained on core unit 21 by ball or other detents 41 or similar mechanisms to temporarily and removably secure and retain hood 31 on core unit 21. In this illustrative embodiment, hood 31 may be removed from core unit 21 simply by pulling upwardly on it, and may be attached simply by pressing it down on core unit 21 until the detents engage.

Figure 3:
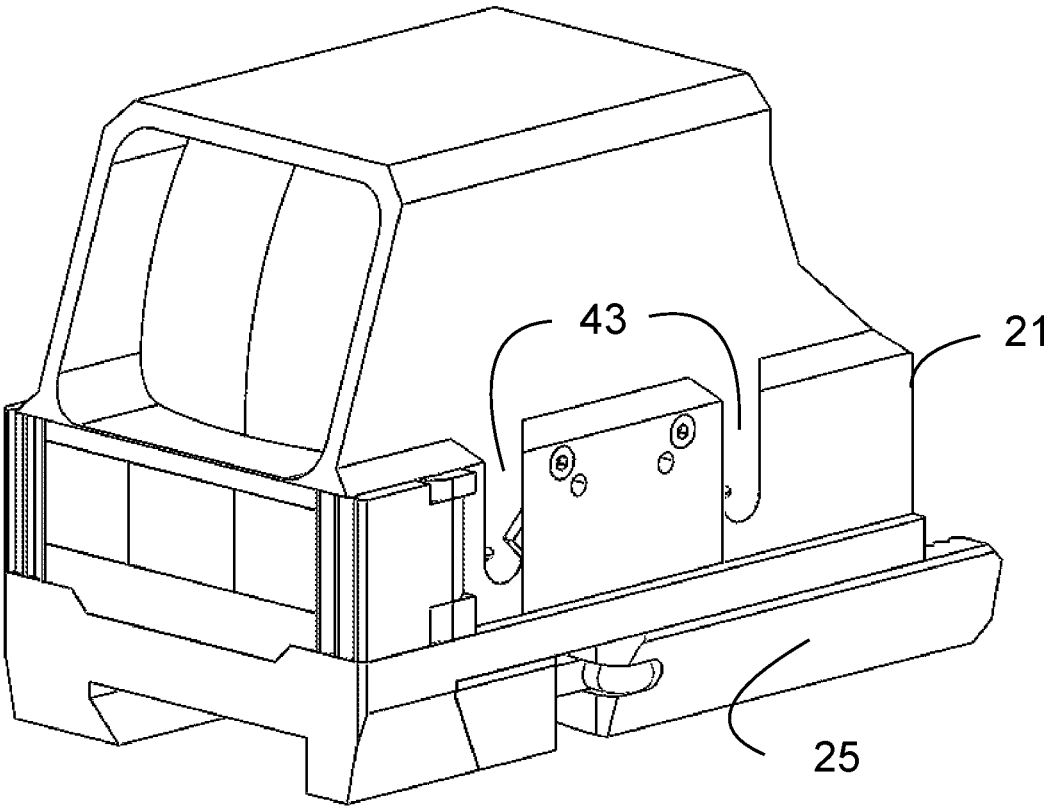
FIGS. 3 and 4 are perspective views of the sight of FIGS. 1 and 2 with the hood removed.
Figure 4:
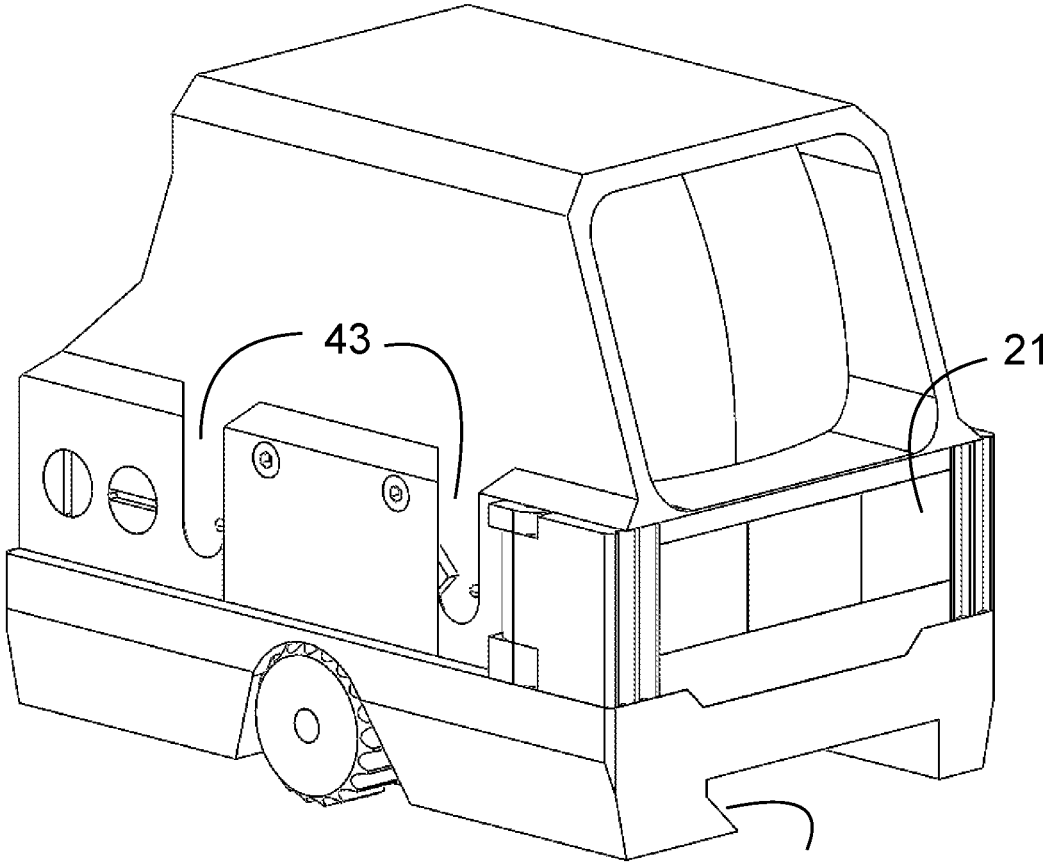
Figure 5:
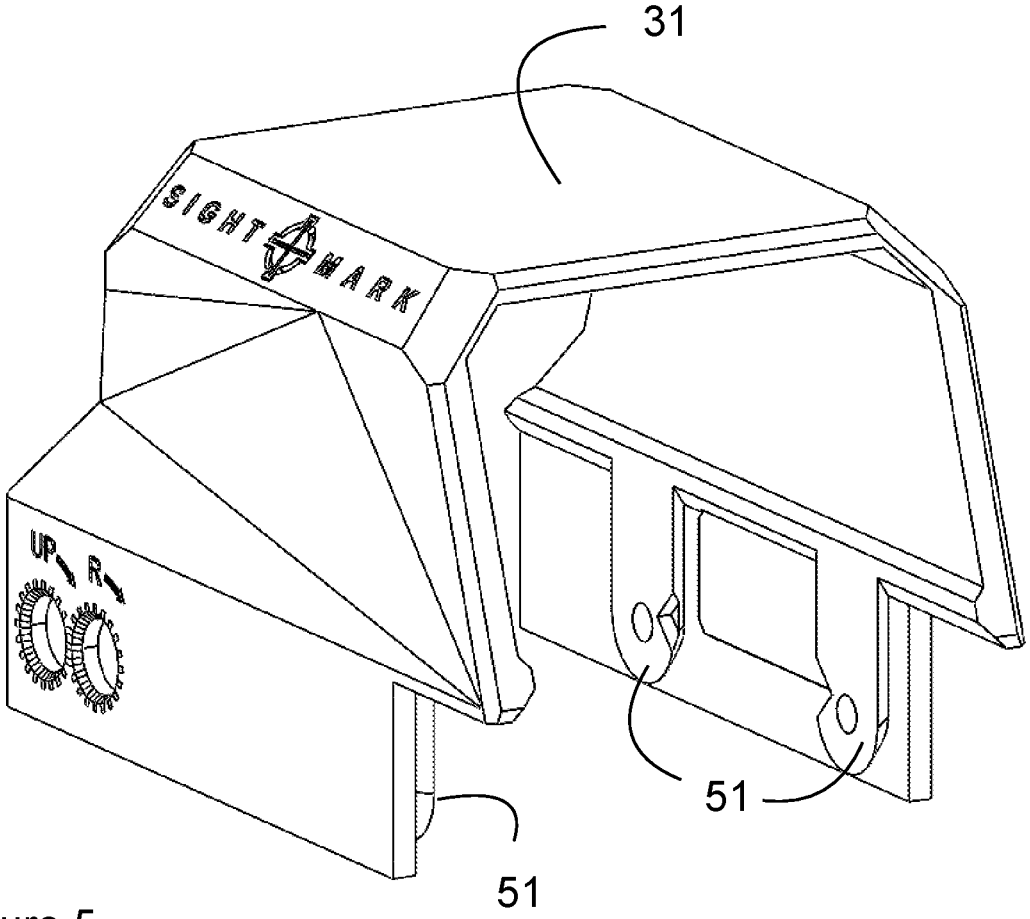
FIG. 5 is a perspective view of the hood removed from the core unit.

As shown in greater detail in FIGS. 3 and 4, core unit 21 may include its own hood structure, separate from removable hood 31. Alternatively, removable hood 31 may be the only hood structure. Detents 41 may be provided in vertically extending slots 43 in the sidewalls of core unit 21. Slots 43 register with correspondingly shaped projections 51 formed on the inner surfaces of hood 31, as illustrated in FIG. 5, which may also be configured to conduct electrical power by placing electrical contacts in slots 43 and on projections 51. Such contacts may comprise the entire contacting surfaces of slots 43 and projections 51, or smaller individual or plural contacts along the respective surfaces. Additionally, ball detents and corresponding receptacles may be disposed in slots 43 and on projections 51 to releasably secure them together, and hood 31 on core unit 21.

Slots 43 and projections 51 may be configured to provide an electrical power connection or circuit to conduct power between the power source in core unit 21 an accessory or device associated with or carried by hood 31. Electrical power may be conducted from an electrical power source (e.g. battery, see description of FIG. 9, below) in core unit 21 to an accessory or device associated with hood 31, or from the device associated with hood 31 to core unit 21 (see FIG. 6 and description). According to a preferred embodiment of the present invention, four slots 43 and corresponding projections 51 may be provided. Two of each may have electric contacts with positive polarity, with the other two having contacts with negative polarity. This arrangement combines the function of a mechanical and electrical connection between hood 31 and core 21, but the connections may be separate.

Figure 6:
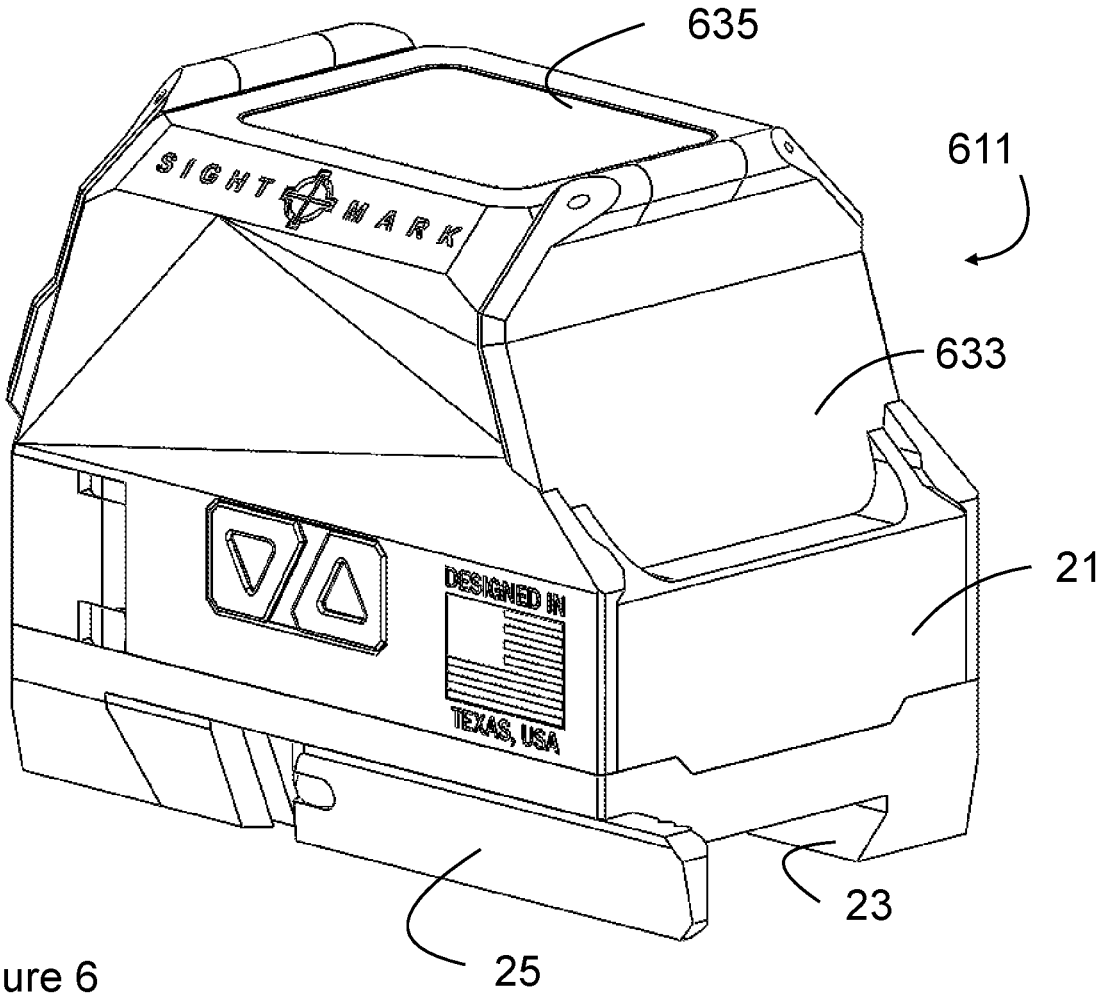
FIG. 6 is a perspective view of a sight in accordance with the present invention incorporating a solar panel and cell into the hood.

FIG. 6 depicts an embodiment of sight 611 in which hood 631, which is of generally similar configuration to that illustrated in FIGS. 1 through 5, incorporates an optional lens caps 633 and solar panel or cell 635 on its top surface. Cell 633 may be used to power the electronics in core unit 21 and/or to charge its battery through the electrical connection 43, 51. Core unit 21 is the same core unit as shown in FIGS. 1 through 5. Hood 631 is also provided with hinged, "flip up" lens covers 635, which are an optional feature.

Figure 7:
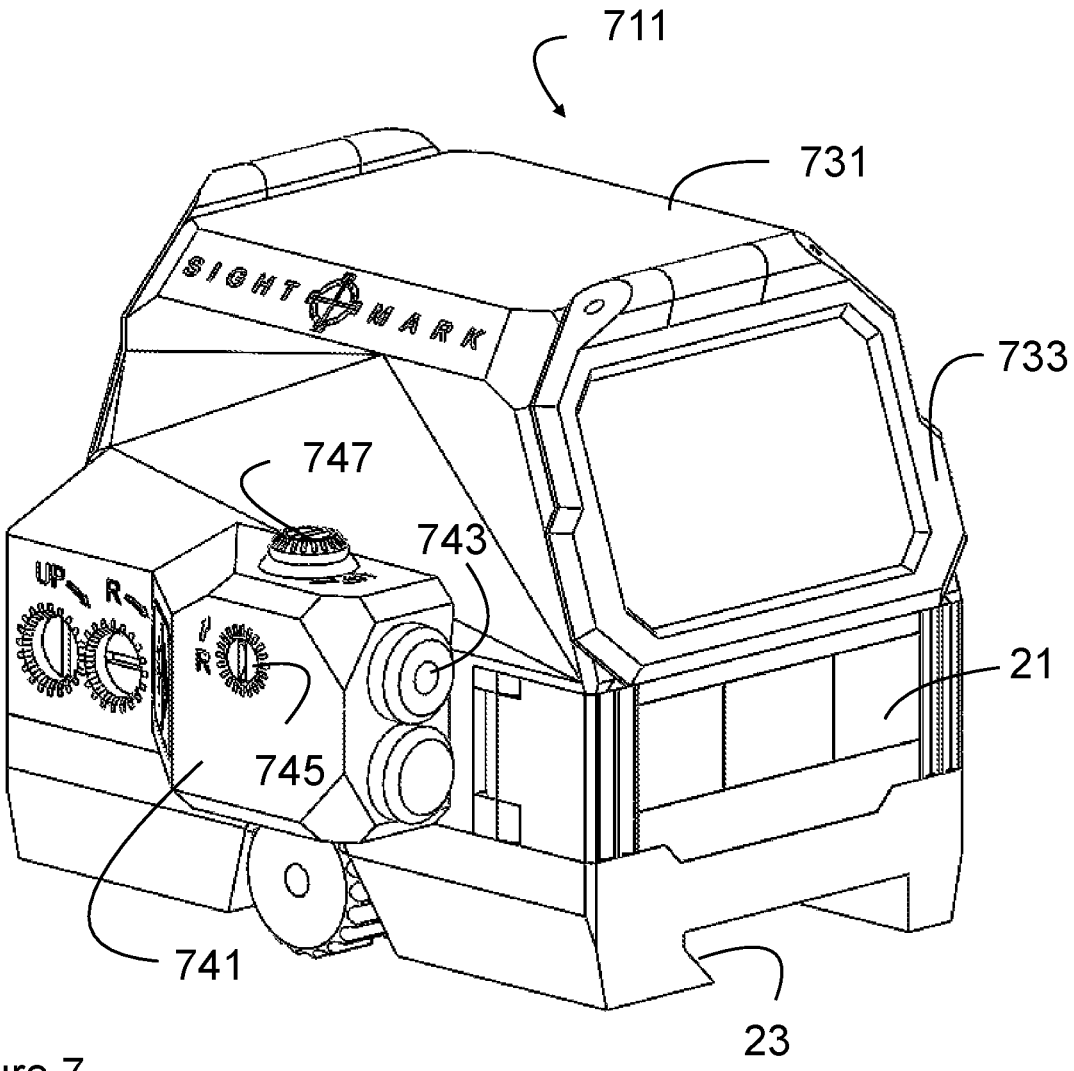
FIG. 7 is a perspective view of a sight in accordance with the present invention incorporating a laser pointer sighting device into the hood.

FIG. 7 illustrates an embodiment of sight 711 in which hood 731 incorporates hinged lens caps 733 and a laser pointer sighting device 741. Hood 731 is of a similar configuration to that illustrated in FIGS. 1 through 5. Laser pointer 741 may be carried on the side of hood 731 and emits a laser beam from aperture 743, which shines downrange and illuminates a target in the conventional manner. Pointer 741 may be provided with windage 745 and elevation 747 adjustment screws or knobs to adjust the aimpoint of the beam. Again, core unit 21 is the same as previously described and laser pointer device 741 may be powered by the battery of core unit 21 through connection 43, 51.

Figure 8:
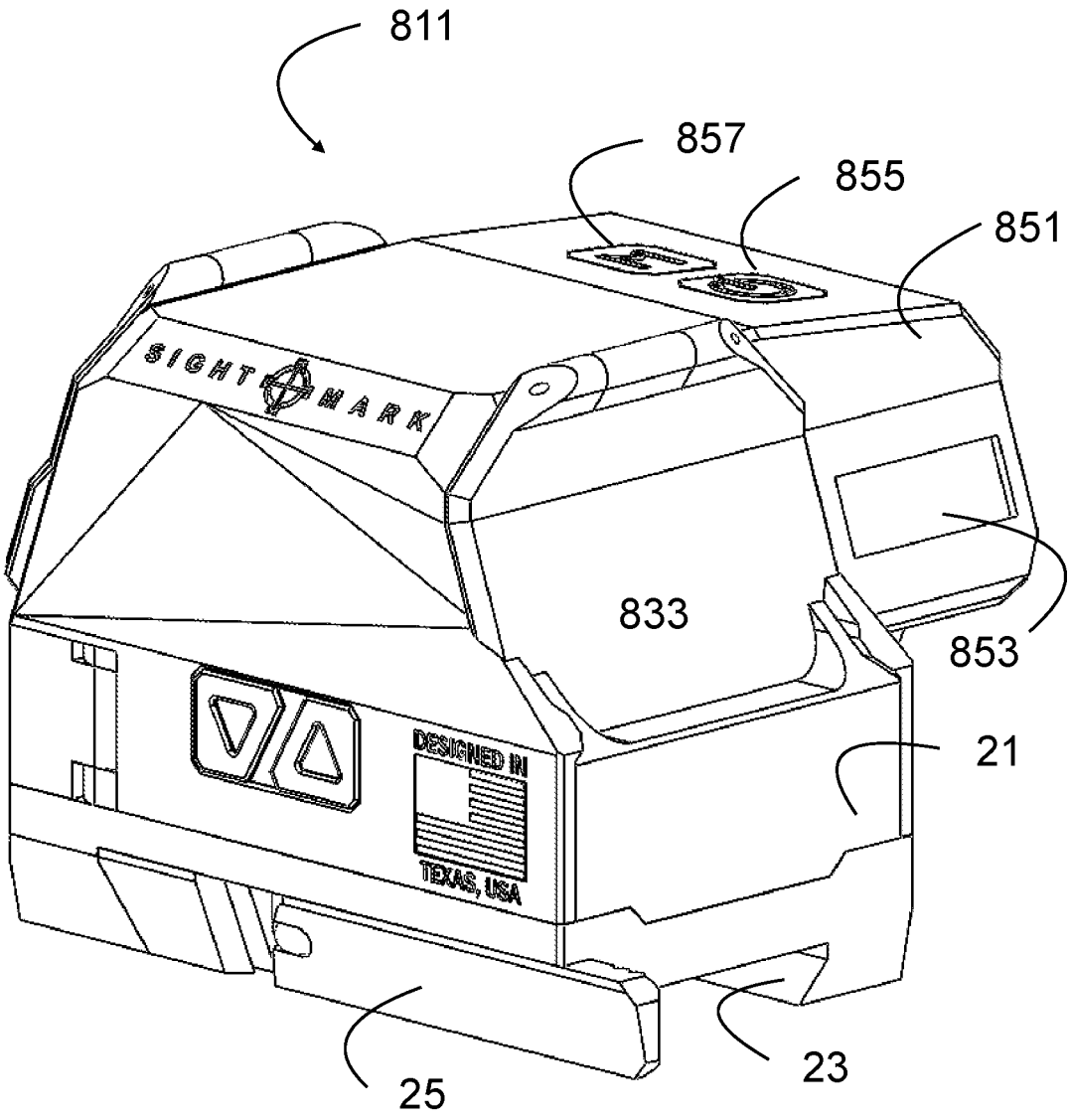
FIG. 8 is a perspective view of a sight in accordance with the present invention incorporating a laser range finder into the hood.

FIG. 8 depicts an embodiment of sight 811 in which hood 831 incorporates a laser range finder (LRF) 851. Hood 831 is of a similar configuration to that illustrated in FIGS. 1 through 5. LRF 851 may be carried on the side of hood 831 and operates conventionally. A numerical digital display 853 may be provided to display the measured range to the user. Power 855 and mode 857 (for example changing units between feet and meters) buttons may be provided on the LRF module 853. Again, core unit 21 is the same as previously described, and LRF 851 may be powered by its battery through electrical connection 43, 51.

Figure 9:
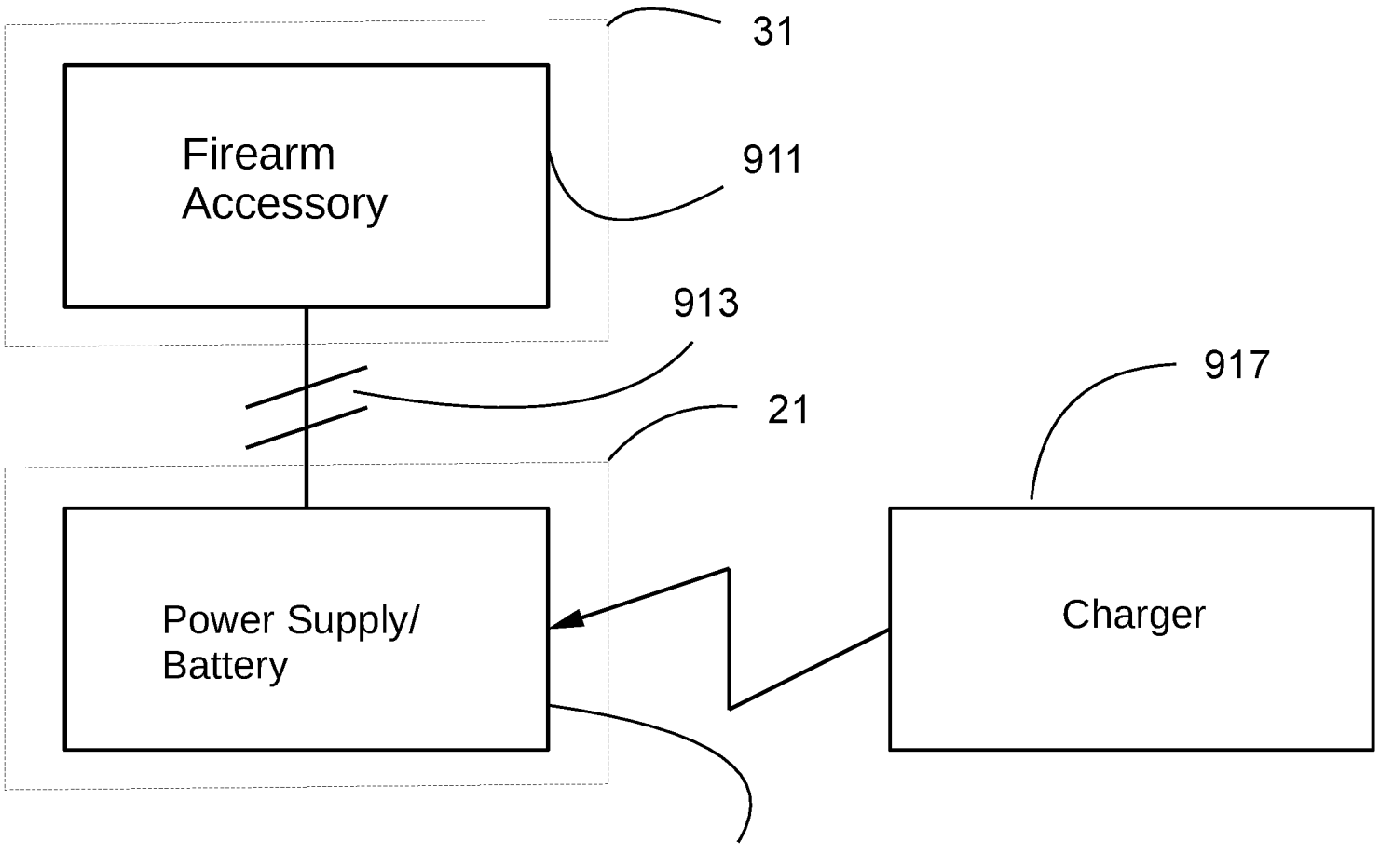
FIG. 9 is a block diagram depicting the relationship between electrical components of the device according to the present invention.

FIG. 9 illustrates by block diagram the relationship of the electrical components of the device according to the present invention. Accessory or sight 911, including the various devices that may be carried by or associated with removable hood 31 as described above, may be detachably or removably electrically connected, via electrical connection 913, to a battery or power supply 915, associated with core 21, as described above.

Battery or power supply 915 is a source of electrical power or energy and may comprise a lithium-ion storage battery, for example, or any other type of battery or device for storing or generating electrical energy and power. It may be removable and replaceable, or more permanently installed and rechargeable in-situ by a conventional charger 917, which may employ a detachable wired connection such as USB-B or -C, or Qi or other wireless or induction charging.

As described above in connection with FIG. 6, the accessory associated with hood 31 may include a power source itself, such as the described solar cell, which can augment or supplement, or temporarily obviate the need for the battery or power supply 915. Preferably, then, connection 913 is capable of conducting or transmitting electrical power between accessory 911 associated with hood 31, and power supply 915 associated with core 21 in "both directions." Electrical connection 913 between battery or power supply 915 and accessory 911 may comprise the slot-and-projection arrangement described above in connection with FIGS. 3 and 4, or another "hot shoe" type of electro-mechanical connection, or any other type of detachable electrical connection, such as a plug and socket, or wireless connections such as induction connections.

As described, the invention provides a single, uniform core or base unit that may be used with a variety of hood modules or units that incorporate accessories. Through the electrical connection provided between the hood and the core unit, the accessories may be electrically powered by the battery or power source in the core unit, or may charge the battery as in the case of the solar-cell accessory described herein. Thus, a sighting device with increased versatility and utility is provided.

The invention has been described in connection with preferred and illustrative embodiments thereof. It is thus not limited, but is susceptible to variation and modification without departing from the scope and spirit of the invention.

We claim:

1. A sighting device configured to be mounted on a firearm, the device comprising:

a core unit that includes a source of electrical power, the core unit configured for attachment to a rail on the firearm;

a hood removably secured to the core unit and enclosing a portion of the core unit and at least partially defining a sight window through the hood; and an electrical connection between the core unit and the hood, wherein electrical power is transmitted between the core unit and the hood.

2. The sighting device of claim 1, wherein the device is a reflex sight.

3. The sighting device of claim 1, wherein the hood includes an electrical accessory carried by the hood.

4. The sighting device of 3, wherein the electrical accessory is one of:

a solar charging cell;

a laser pointer sighting device powered by the core unit; and a laser range-finding device powered by the core unit.

5. The sighting device of claim 3, wherein the electrical connection between the core unit and hood is electromechanical and the electric power is conducted between the core unit and hood.

6. A sighting device configured to be mounted on a firearm, the device comprising:

a core unit including an electrical power supply and a clamp for removably securing the core unit to a rail on the firearm;

a hood removably secured to the core unit and at least partially defining a sight window through the hood;

an electrical accessory carried by the hood; and a connection between the core unit and the hood, wherein electrical power is transmitted between the core unit and the hood.

7. The sighting device of claim 6, wherein the electrical accessory is one of:

a solar charging cell;

a laser pointer sighting device powered by the core unit; and a laser range-finding device powered by the core unit.

8. The sighting device of claim 6, wherein the connection comprises:

at least one slot formed in the core unit;

at least one projection formed in the hood and configured to register and engage with the slot in the core unit upon assembly together; and an electrical contact in each slot and on each projection, wherein upon assembly together, and electrically conductive circuit is established between the electrical power supply and the electrical accessory.

9. The sighting device of claim 6, wherein the device is a reflex sight.

10. A sighting device configured to be mounted on a firearm, the device comprising:

a core unit including a clamp for securing the core unit to a rail on the firearm;

a hood removably secured to the core unit and at least partially defining a sight window through the hood;

at least one slot formed in the core unit; and at least one projection formed in the hood and configured to register and engage with the slot in the core unit upon assembly together.

11. The sighting device of claim 10, further comprising:

an electrical power source in the core unit;

an electrical accessory carried by the hood; and a connection between the core unit and the hood, wherein electrical power is transmitted between the electrical power source in the core unit and the hood.

12. The sighting device of claim 11, wherein the electrical accessory is one of:

a solar charging cell;

a laser pointer sighting device powered by the core unit; and a laser range-finding device powered by the core unit.

13. The sighting device of claim 11, further comprising:

an electrical contact in each slot and on each projection, wherein upon assembly together, and electrically conductive circuit is established between the electrical power supply and the electrical accessory.

14. The sighting device of claim 10, wherein the device is a reflex sight.

15. The sighting device of claim 10, further comprising ball detents between each slot and projection.

* * * * *